US010670252B1

(12) United States Patent
Fan

(10) Patent No.: US 10,670,252 B1
(45) Date of Patent: Jun. 2, 2020

(54) WIRE CONTROL SWITCH AND MOBILE LIGHTING APPARATUS

(71) Applicant: Olight Technology Co., Limited, Guangdong (CN)

(72) Inventor: Jiang Fan, HuBei (CN)

( * ) Notice: Subject to any disclaimer, the term of this patent is extended or adjusted under 35 U.S.C. 154(b) by 19 days.

(21) Appl. No.: 16/183,745

(22) Filed: Nov. 8, 2018

(51) Int. Cl.

| | |
|---|---|
| ***H01R 11/30*** | (2006.01) |
| ***F21V 23/04*** | (2006.01) |
| ***H01R 13/70*** | (2006.01) |
| ***H01R 13/62*** | (2006.01) |
| ***H01R 12/71*** | (2011.01) |
| *H01R 12/70* | (2011.01) |

(52) U.S. Cl.
CPC ..... *F21V 23/0421* (2013.01); *H01R 12/714* (2013.01); *H01R 13/6205* (2013.01); *H01R 13/70* (2013.01); *H01R 12/7076* (2013.01); *H01R 12/7088* (2013.01)

(58) Field of Classification Search
CPC ..... F21V 23/0421; H01R 12/714; H01R 12/7076; H01R 12/7088; H01R 13/6205; H01R 13/70
USPC ..... 439/38, 188
See application file for complete search history.

(56) References Cited

U.S. PATENT DOCUMENTS

| | | | | | |
|---|---|---|---|---|---|
| 1,679,722 | A * | 8/1928 | Hubbell | H01R 13/70 | 200/51 R |
| 2,022,155 | A * | 11/1935 | Sawyer | H01R 13/70 | 307/112 |
| 2,149,049 | A * | 2/1939 | Gough | H01R 13/70 | 200/51 R |
| 4,466,686 | A * | 8/1984 | Houser | H01H 9/08 | 439/441 |
| 8,133,073 | B2 * | 3/2012 | Buchberger | H01R 9/03 | 200/51.03 |
| 10,483,018 | B1 * | 11/2019 | Chiu | H01B 7/32 | |

* cited by examiner

*Primary Examiner* — Khiem M Nguyen
(74) *Attorney, Agent, or Firm* — Prakash Nama; Global IP Services, PLLC

(57) ABSTRACT

The wire control switch comprises a shell, a PCB board disposed in the shell, and a switching device electrically connected to the PCB board. The shell has a first end which is provided with a conductive cap. The conductive cap is connected with the shell in an electrically insulated manner. The PCB board is electrically connected to the conductive cap and the shell respectively. A magnet is provided inside the shell at an end which is close to the conductive cap. The mobile lighting apparatus comprises a lamp holder and a lamp body connected to one end of the lamp holder, and an end of the lamp body which is distant from the lamp holder is connected with the aforementioned wire control switch. The present invention achieves magnetic connection between the wire control switch and the mobile lighting apparatus, resulting in convenience in disassembly and assembly and reduced operation difficulty.

10 Claims, 2 Drawing Sheets

WIRE CONTROL SWITCH AND MOBILE LIGHTING APPARATUS

BACKGROUND OF THE INVENTION

The present invention belongs in the field of mobile lighting apparatus technology, in particular to a wire control switch and a mobile lighting apparatus.

In a common wire control switch for mobile lighting apparatus, when in use, it is first required to replace the original end cap of the mobile lighting apparatus with the wire control switch before operation. The inconvenience of this type of design is that the end cap needs to be removed. Under insufficient lighting conditions outdoors, users basically put on outdoor gear, usually with a pair of gloves; this makes the removal of the end cap of the mobile lighting apparatus rather inconvenient, resulting in increased difficulties in user operation and poor user experience.

BRIEF SUMMARY OF THE INVENTION

In view of the deficiencies of the prior art, the present invention provides a wire control switch and a mobile lighting apparatus which are convenient to connect.

To attain this, the present invention adopts the following technical solutions:

A wire control switch comprises a shell, a PCB board, and a switching device electrically connected with the PCB board. The PCB board is disposed inside the shell. The shell has a first end which is provided with a conductive cap. The conductive cap is connected with the shell in an electrically insulated manner. The PCB board is electrically connected to the conductive cap and the shell respectively. A magnet is provided inside the shell at an end which is close to the conductive cap.

Further, the magnet is pressed tightly inside the shell by an end ring; a soft pad for preventing the magnet from being press-damaged is provided at an end of the magnet which is distant from the end ring.

Further, a CD pattern deoxidized layer for positive pole electrical conduction is provided at a side of the end ring which is distant from the magnet.

Further, an insulated sleeve is sleeved on a side wall of the conductive cap.

Further, the PCB board and the shell are electrically connected by an elastic wire.

Further, the elastic wire has a first end which is fixedly and electrically connected with the PCB board; a second end of the elastic wire which is distant from the PCB board is elastically and electrically connected with the shell.

Further, the switching device and the PCB board are electrically connected by a wire; the wire has a first end which is electrically connected with the switching device; a second end of the wire which is distant from the switching device is electrically connected with the PCB board.

Further, a wire stopper for fixing the wire is provided at a second end of the shell which is close to the switching device.

Further, a first end of the PCB board which is close to the conductive cap is provided with a conductive spring; a first end of the conductive spring is electrically connected with the PCB board; a second end of the conductive spring which is distant from the PCB board is electrically connected with the conductive cap.

A mobile lighting apparatus comprises a lamp holder and a lamp body connected to an end of the lamp holder, and an end of the lamp body which is distant from the lamp holder is connected with the aforementioned wire control switch.

The beneficial effects of the present invention are as follows:

The present invention is provided with a magnet, and the wire control switch is connected with the mobile lighting apparatus by means of magnetic attraction, resulting in convenience in disassembly and assembly and reduced operation difficulty. The magnet of the present invention is provided with a soft pad at one end, which can prevent the magnet from being pressed-damaged during the assembling process and ensure normal operation of the magnet.

Figure 1:
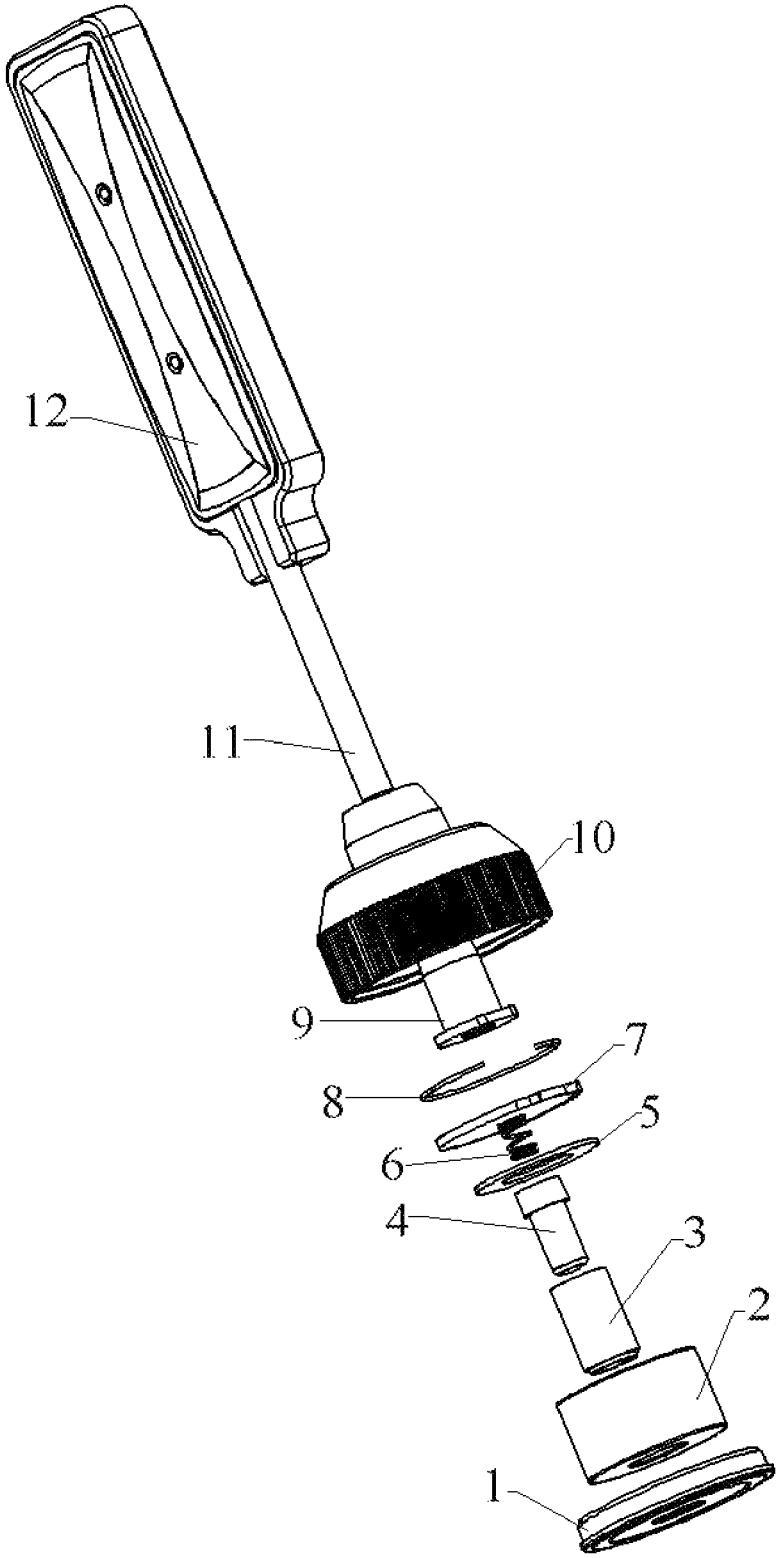
FIG. 1 is a schematic exploding structural view of the wire control switch.

References in the figures: 1—end ring, 2—magnet, 3—insulated sleeve, 4—conductive cap, 5—soft pad, 6—conductive spring, 7—PCB board, 8—elastic wire, 9—wire stopper, 10—shell, 11—wire, 12—switching device.

DETAILED DESCRIPTION OF THE INVENTION

The embodiments of the present invention are described in detail below, examples of the embodiments are illustrated in the drawings, wherein the same or similar references are used to refer to the same or similar elements or elements carrying the same or similar functions. The specific embodiments described below with reference to the drawings are intended to be exemplary and are used only for explaining the present invention, but not for limiting the present invention.

In the description of the present invention, it shall be understood that the direction or position relationships indicated by the terms of "length", "width", "up", "down", "front", "rear", "left", "right", "vertical", "horizontal", "top", "bottom", "inside", "outside", etc. are the direction or position relationships based on the drawings, and are only for convenience of describing the present invention and simplifying the description, rather than indicating or implying that the indicated device or element must have the specific direction and must be constructed and operated in the specific direction, and thus it can't be comprehended as the limitation to the present invention.

In addition, the terms of "first" and "second" are used for the purpose of description only, and can't be comprehended as indicating or implying the relative importance or implying the quantity of the indicated technical features. Therefore, the features limited by "first" and "second" can obviously or implicitly comprise one or more such features. In the description of the present invention, "multiple" means two or more, unless otherwise limited.

In the embodiments of the present invention, unless otherwise specified and limited, the terms of "installation", "in connection", "connection", "fixation", etc. shall be comprehended in a broad sense, for example, it can be either fixedly connected, or detachably connected or in integration; it can be either mechanically connected or electrically connected; it can be either directly connected or indirectly connected through an intermediate, and it can be the internal interconnection of two elements or the interaction of two elements. For the common technicians of this field, the specific meanings of the above terms in the present invention can be comprehended according to the specific conditions.

Figure 2:
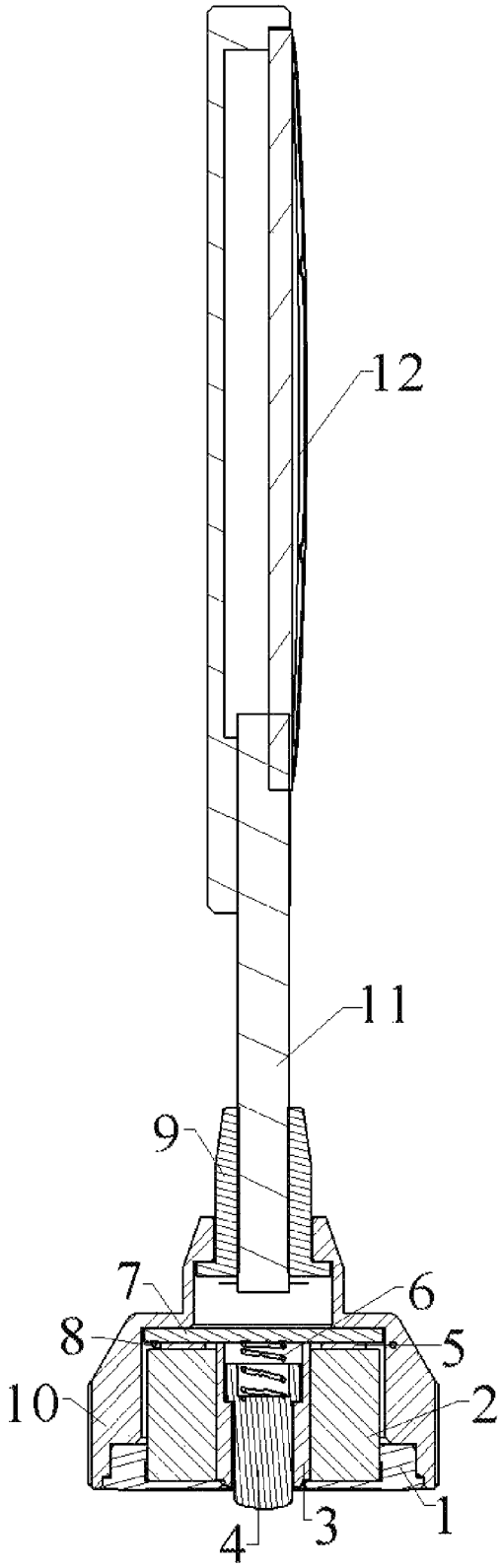
FIG. 2 is a sectional view of the wire control switch structure.

With reference to FIGS. 1 and 2, the present embodiment provides a wire control switch which comprises a shell 10, a PCB board 7 and a switching device 12 electrically connected with the PCB board 7. The PCB board 7 is disposed inside the shell 10. The shell 10 has a first end which is provided with a conductive cap 4. The conductive cap 4 is connected with the shell 10 in an electrically insulated manner. The PCB board 7 is electrically connected to the conductive cap 4 and the shell 10 respectively. A magnet 2 is provided inside the shell 10 at an end which is close to the conductive cap 4.

In the present embodiment, the shell 10 is a chamber with two open ends. The shell 10 has an outer surface which is oxidized to prevent electrical conduction. The shell 10 has an inner portion which is partially deoxidized to achieve electrical connection with other components in the shell 10. The shell 10 is used as a positive pole of a switching circuit. In the present embodiment, the PCB board 7 is disposed close to an open end of the shell 10. The switching device 12 is electrically connected to the PCB board 7 by a wire 11 to achieve switching control of the power supply circuit by the switching device 12. The wire 11 has a first end which is electrically connected to the switching device 12; a second end of the wire 11 passes through the open end of the end of the shell 10 which is close to the PCB board 7 to connect to the PCB board 7. The open end of the shell 10 which is close to the switching device 12 is provided with a wire stopper 9 for fixing the wire 11, thereby preventing the wire 11 from swaying relative to the shell 10, hence avoiding the wire 11 from being worn and increasing the service life. The wire stopper 9 is fixedly connected to the shell 10 by adhesive means. The wire stopper 9 is made of soft plastic materials. In the present embodiment, the PCB board 7 and the shell 10 are electrically connected by an elastic wire 8. The elastic wire 8 has a first end which is electrically connected with the PCB board 7 by welding; a second end of the elastic wire 8 is in contact with the deoxidized layer of the shell 10 to achieve electrical connection. The elasticity of the elastic wire 8 achieves stable electrical connection between the elastic wire 8 and the shell 10. In the present embodiment, the elastic wire 8 is a gold-plated steel piano wire. In other embodiments, the wire stopper 9 is integrally formed with the shell 10, and the elastic wire 8 is a piano wire.

In the present embodiment, the conductive cap 4 is disposed at the opening of the end of the shell 10 which is distant from the switching device 12. A first end of the conductive cap 4 is electrically connected to the PCB board 7 in the chamber of the shell 10; a second end of the conductive cap 4 passes through the open end of the shell 10 and is exposed outside the shell 10 for convenient electrical conductive connection with a mobile lighting apparatus. The conductive cap 4 serves as a negative pole of the circuit. In the present embodiment, a conductive spring 6 is welded to one side of the PCB board 7 which is close to the conductive cap 4 to achieve electrical connection between the conductive spring 6 and the PCB board 7. The end of the conductive spring 6 which is distant from the PCB board 7 is in contact with and electrically connected with the conductive cap 4. The end of the conductive cap 4 which is close to the PCB board 7 is provided with a recess for limiting the conductive spring 6 to prevent the conductive spring 6 from swaying relative to the conductive cap 4. The end of the conductive spring 6 which is distant from the PCB board 7 is located in the recess on the conductive cap 4 to press against the conductive cap 4, thereby achieving electrical connection between the conductive spring 6 and the conductive cap 4, hence achieving electrical connection between the PCB board 7 and the conductive cap 4. An insulated sleeve 3 is provided on an outer side of a side wall of the conductive cap 4 to achieve electrical insulation between the conductive cap 4 and the shell 10. In the present embodiment, the conductive cap 4 is a brass cap with a gold-plated outer surface to achieve a good electrical signal transmission. In other embodiments, the conductive cap 4 may also be conductive structures such as brass cap or aluminum cap.

In the present embodiment, the magnet 2 is disposed surrounding the outer periphery of the insulated sleeve 3, and the open end of the shell 10 is provided with an end ring 1 for pressing the magnet 2 tightly inside the shell 10. The interference fit between the end ring 1 and the shell 10 achieves secure connection; and the end ring 1 is electrically connected to the shell 10. The end ring 1 and the shell 10 serve as the positive pole of the circuit. The end ring 1 is provided with a hole for the conductive cap 4 to pass through. The insulated sleeve 3 is disposed between the conductive cap 4 and the end ring 1 to achieve electrical insulation between the conductive cap 4 and the end ring 1, thereby achieving electrical insulation between the shell 10 being the positive pole and the conductive cap 4 being the negative pole. The side of the end ring 1 which is distant from the magnet 2 is provided with an annular conductive interface for positive pole electrical conduction, and the annular conductive interface is used for electrical contact with the shell of the mobile lighting apparatus. In the present embodiment, a soft pad 5 is disposed between the magnet 2 and the PCB board 7 to prevent the magnet 2 from being damaged by large impact force when the end ring 1 is pressed during installation, so that the magnet 2 can provide stable magnetic attractive force. In other embodiments, the end ring 1 and the shell 10 may be integrally formed by injection molding.

When in use, under the effect of the magnet 2, the wire control switch can be attached on the end cap of the mobile lighting apparatus. The conductive cap 4 is in electrical contact with the conductive end of the mobile lighting apparatus. The annular conductive interface of the end ring 1 is in electrically contact with the shell of the mobile lighting apparatus. As a result, the switching of the mobile lighting apparatus can be controlled by the switching device 12 directly.

In the present embodiment, a mobile lighting apparatus comprising a lamp holder and a lamp body connected to one end of the lamp holder is also provided. The end of the lamp body which is distant from the lamp holder is connected to the aforementioned wire control switch. In the present embodiment, the end of the lamp body which is distant from the lamp holder is provided with a magnet having a polarity opposite to the magnet 2, thereby achieving magnetic connection between the wire control switch and the lamp body. The end of the lamp body which is distant from the lamp holder is further provided with a conductive end for electrical connection with the conductive cap 4. The side of the shell of the lamp body which is close to the wire control switch is provided with an annular region for electrical conduction. During assembling, the wire control switch and the lamp body are fixedly connected by mutual attraction between the two magnets. The conductive end on the lamp body is electrically connected to the conductive cap 4 of the wire control switch. Under the effect of the conductive spring 6 inside the wire control switch, the conductive cap 4 can achieve stable electrical contact with the conductive end on the lamp body. The electrically conductive annular region on the shell of the lamp body is electrically connected to the annular conductive region on the end ring 1 of the wire control switch, thereby achieving direct control of the switching of the mobile lighting apparatus by the wire control switch and convenient operation.

The embodiments described above are only one of the preferred embodiments of the present invention, the usual changes and substitutions made by those skilled in the art within the scope of the present invention are included in the scope of protection of the present invention.

What is claimed is:

1. A wire control switch comprising a shell (10), a PCB board (7) and a switching device (12) electrically connected with the PCB board (7), the PCB board (7) is disposed inside the shell (10); characterized in that the shell (10) has a first end which is provided with a conductive cap (4); the conductive cap (4) is connected with the shell (10) in an electrically insulated manner; the PCB board (7) is electrically connected to the conductive cap (4) and the shell (10) respectively; a magnet (2) is provided inside the shell (10) at an end which is close to the conductive cap (4).

2. The wire control switch as in claim 1, characterized in that the magnet (2) is pressed tightly inside the shell (10) by an end ring (1); a soft pad (5) for preventing the magnet (2) from being press-damaged is provided at an end of the magnet (2) which is distant from the end ring (1).

3. The wire control switch as in claim 2, characterized in that a CD pattern deoxidized layer for positive pole electrical conduction is provided at a side of the end ring (1) which is distant from the magnet (2).

4. The wire control switch as in claim 1, characterized in that an insulated sleeve (3) is sleeved on a side wall of the conductive cap (4).

5. The wire control switch as in claim 1, characterized in that the PCB board (7) and the shell (10) are electrically connected by an elastic wire (8).

6. The wire control switch as in claim 5, characterized in that the elastic wire (8) has a first end which is fixedly and electrically connected with the PCB board (7); a second end of the elastic wire (8) which is distant from the PCB board (7) is elastically and electrically connected with the shell (10).

7. The wire control switch as in claim 1, characterized in that the switching device (12) and the PCB board (7) are electrically connected by a wire (11); the wire (11) has a first end which is electrically connected with the switching device (12); a second end of the wire (11) which is distant from the switching device (12) is electrically connected with the PCB board (7).

8. The wire control switch as in claim 1, characterized in that a wire stopper (9) for fixing the wire (11) is provided at a second end of the shell (10) which is close to the switching device (12).

9. The wire control switch as in claim 1, characterized in that a first end of the PCB board (7) which is close to the conductive cap (4) is provided with a conductive spring (6); a first end of the conductive spring (6) is electrically connected with the PCB board (7); a second end of the conductive spring (6) which is distant from the PCB board (7) is electrically connected with the conductive cap (4).

10. A mobile lighting apparatus comprising a lamp holder and a lamp body connected to an end of the lamp holder, characterized in that an end of the lamp body which is distant from the lamp holder is connected with the wire control switch as in claim 1.

* * * * *